United States Patent [19]

Scholtholt et al.

[11] 4,136,920

[45] Jan. 30, 1979

[54] WIRE CLAMPING ELEMENT

[75] Inventors: Hans Scholtholt, Lohhof; Ewald Steiner, Allmannshausen, both of Germany

[73] Assignee: Siemens Aktiengesellschaft, Berlin & Munich, Germany

[21] Appl. No.: 846,175

[22] Filed: Oct. 27, 1977

[30] Foreign Application Priority Data

Oct. 28, 1976 [DE] Fed. Rep. of Germany ..... 2649098

[51] Int. Cl.[2] ..... H01R 9/08

[52] U.S. Cl. ..... 339/98

[58] Field of Search ..... 339/97 P, 98

[56] References Cited

U.S. PATENT DOCUMENTS

| | | | |
|---|---|---|---|
| 3,112,147 | 11/1963 | Pferd et al. | 339/97 P |
| 3,521,221 | 7/1970 | Lenaerts et al. | 339/97 P |
| 3,617,983 | 11/1971 | Patton | 339/98 |
| 3,702,456 | 11/1972 | Patton | 339/98 |

FOREIGN PATENT DOCUMENTS

| | | | |
|---|---|---|---|
| 2131769 | 12/1972 | Fed. Rep. of Germany | 339/97 P |
| 1276449 | 6/1972 | United Kingdom | 339/98 |

*Primary Examiner*—Joseph H. McGlynn
*Attorney, Agent, or Firm*—Hill, Gross, Simpson, Van Santen, Steadman, Chiara & Simpson

[57] ABSTRACT

A wire insulation piercing clamping element is formed of punched out flat sheet stock having two wire clamping slots separated by a common center post, each of the slots having clamping areas of different width, the clamping areas defined at throat openings thereto by contours forming insulation piercing edges.

4 Claims, 2 Drawing Figures

WIRE CLAMPING ELEMENT

BACKGROUND OF THE INVENTION

1. Field of the Invention

This invention relates to electric clamping elements and more particularly to insulation slitting or piercing contact clamps.

2. Prior Art

This invention is directed to that type of electrical contact clamping element which engages the conductor core of an electrical wire surrounded by an insulation jacket without requiring stripping of the jacket.

Particularly this invention is directed to that type of clamping element that has two adjacent clamping slots open to a common end of the element and defined by bar members. Such clamping elements must of course have a construction giving proper electrical contact. In addition they must also have a sufficiently large spring force to insure that the insulation jacket is pierced or slit completely through to the conductive wire core when the insulated wire is pressed into the clamping slot.

The prior art has attempted to meet these two basic requirements in one construction by creating the element out of two parts formed of different materials. In such a construction one of the parts, which may form the center post or the central bar will be formed of a particularly good electrical conductor material such as, for example, nickel silver. The other part forms the exterior bars. These are separated from one another by the center post and wire clamping slots are defined between the exterior bars and the center post. This other part may be formed of a material exhibiting desired resilient properties. Such a resilient material may, for example, be beryllium. The two separate parts are then properly positioned with respect to one another and are thereafter connected by means such as spot welding.

The aforementioned type of known clamping element is deficient in that because of the usage of different materials and the resultant assembly and connection production steps, the resultant element is expensive.

To reduce expense, it has been known to form the element from a strip of material which is punched to define spaced clamping slots. The material is chosen for the desired electrical conductivity. In this type of single piece construction, due to the resilient deficiency of the good conductor materials, the element can only be used a few times. That is to say that repeated insertion of insulated wires into the slot will overstretch the exterior bars to the extent that their spring tension will be insufficient to properly pierce the insulation of subsequently inserted wires. This type of element can thereafter only be properly used in connection with a tool which spans the exterior bars during wire clamping. An additional deficiency of such prior constructions is the fact that they are usable only with insulated wires having a conductive core of one size or, when using subsequently clamped wires, the element can be used only with insulated wires having increasing conductor core diameters. It is only in these instances that the element can assure a reliable electric contact.

It would therefore be an improvement in the art to provide a single material double slot electrical contact element which provides sufficient spring strength to insure proper installation piercing while allowing usage with conductor cores of differing diameters without the necessity of using a tool during the clamping process.

SUMMARY OF THE INVENTION

It is therefore a principle object of this invention to provide a single material electrical clamping element formable of punched sheet material having parallel spaced wire receiving slots with insulation piercing openings, the slots spaced from one another by a common center post and defined by exterior posts and wherein the slots can accommodate different core diameter wires without the necessity of using a tool during wire insertion.

This principle object is achieved in that the clamping element is formed from a flat strip of constant thickness material having good electrical conductivity. The strip is punched to define a central post and spaced side bar elements with slots therebetween. After punching, the strip is folded back upon itself. The center bar is free cut and projects upwardly between the side bars which are of double thickness. The clamping slots, defined between the side bars and the center bar are each formed having at least two clamping areas having different widths. The clamping areas have throat openings thereto defined between insulation cutting or piercing edges formed as contours of the side walls of the center and side posts. In the preferred embodiment illustrated, the clamping areas are positioned in series with the throat opening of the bottommost clamping area being defined at a base of the upper clamping area and the throat opening of the upper clamping area being defined adjacent an upper portion of the slot.

A clamping element constructed according to this invention has a number of specific advantages. First the construction method is simple and therefore low cost. Second by utilizing a good electrical conductor material, it is assured that proper electrical conductivity will exist. By forming the exterior bars as folded back portions of double thickness, it is assured that in spite of the fact that known good electrical conductive materials are of relatively low spring strength, that the overall spring strength of the assembly will be adequate to insure repeated insulation piercing. Finally by providing graduated size clamping areas within the clamping slot, it is assured that the element is usable with varying diameter or gauge wires. For example by graduating the actual clamping slot areas, conductors or wires of a specific diameter range can be utilized, for example a range of 0.4 through 0.6 mm wire size could be used in the same element. If the conductor insulation is not adequately cut through in the first clamping area adjacent the slot insertion opening, the conductor will be reliably contacted when it is pressed further into the succeeding clamping area. By use of the graduated size clamping areas within a single slot, and providing separate cutting edges at each of the clamping areas, it is possible to insure that a reliable electrical contact will be made even in those instances where the particular wire has a dual insulation layer. For example a proper electrical connection will be insured when the wire consists of an electrically conductive core encircled by polyvinyl chloride and a nylon coat.

Additionally the use of a second, smaller clamping area will guarantee excellent electrical connection in those cases when the first clamping area has been enlarged by subjection to wires having too large a diameter. In such situations it is possible for the first clamping area to be enlarged to the point that its interior diameter is larger than the core diameter of the wire. In such cases the smaller second gripping area will insure piercing of the insulation and establishment of an electrically conductive clamped connection.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
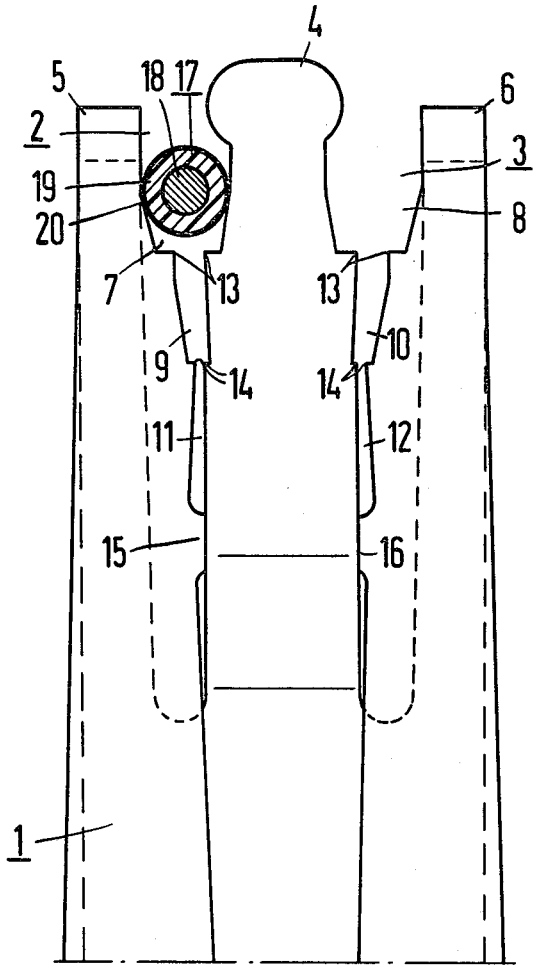
FIG. 1 is a front plan view of the clamping element according to this invention.
Figure 2:
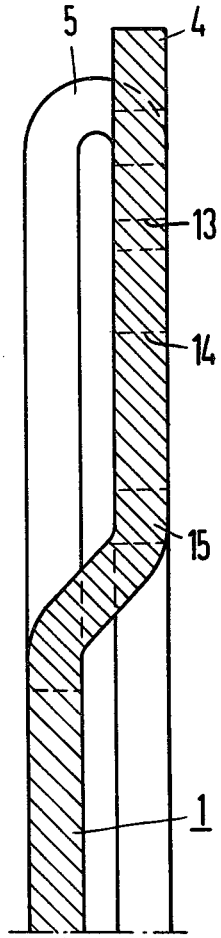
FIG. 2 is a lateral view, partially in section, of the element of FIG. 1.

The clamping element illustrated in FIGS. 1 and 2 is formed of a flat strip or sheet of uniform thickness electrically conductive material. In the formation of the clamping element, it is cut or punched to form contours which define clamping slots 2 and 3 with a central free ended center post 4. The strip is subsequently folded in such a manner that the center post 4 will be positioned between the bars 5 and 6 with the slots open at one end of the element. The center post 4 is then angularly bent to a vertically offset position where it extends between the contours formed on the outer posts or bars 5 and 6 as illustrated by the offset of the cross section of FIG. 2.

The clamping slots 2 and 3 are each divided into several clamping areas having different inside diameters or dimensions. Thus the areas 7 and 8 which are formed at the open end of the slots represent insertion openings for the slots for receipt of a conductor wire 17 which is to be clamped within the element 1. The insertion opening is preferably dimensioned such that the conductor wire can be relatively securely held for purposes such as prewiring. To this end the center posts may have a bulbous head which partially restricts the end of the openings 7 and 8 and both the outer bars and the central posts may have slightly convergent side walls in the area of the insertion openings 7 and 8. Thus the wire 17 can be held therein by engagement with its insulation covering.

Additional clamping areas 9 and 11 or 10 and 12 extend in series from the insertion openings 7 and 8. The clamping areas 9 and 10 have ends open to the insertion areas 7 and 8 and are narrower than the insertion openings. The clamping areas 11 and 12 have ends open to the clamping areas 9 and 10 and are relatively narrower than those areas. Thus the slots each become narrower from the insertion opening 2 or 3 through the first clamping area 9 and 10 to the next clamping area 11 and 12. The juncture between the insertion opening and the clamping area 9 and 10 has side wall configurations formed respectively by a ledge like protrusions of the side walls of the end bars or posts 5 and 6 and the side walls of the center posts 4. These contour form insulation cutting edges 13. Similarly the opening to the areas 11 and 12 are formed with cutting edges 14 having a dimension narrower than the edges 13.

The edges 13 and 14 are such as to assure that when the wire 17 is pressed downwardly in the slot 2 or 3, that the insulation covering will be spread apart, or cut through, to the wire conductive core 18 such that it will be engaged by the clamping element 1. The clamping area 9 or 10 which is situated closest to the insertion opening is used, for example, to accommodate wires having such a conductive core diameter or gauge as to be enclamped in the relatively larger dimension of the clamping area 9 or 10. Preferably it is assured that this area and the cutting edges 13 are such as to pierce such connectors even when they have a shielding which consists of two layers 19 and 20. The slot area 11 or 12 following after the slot 9 or 10 can accommodate connecting wires of smaller diameter whose insulation is then cut through by the edges 14. The edges 14 are also effective in those cases when the inside diameter of the first slot area 9 or 10 has been enlarged. Such enlargement can occur when a material of relatively lesser spring strength is used for the clamping element and when thereafter a number of wires have been clamped on and removed from the element 1, particularly when those wires have had too large a conductor core diameter. In such cases, upon continued usage it can occur that the edges 13 will be spaced apart from one another sufficient to inadequately pierce the insulation of a standard diameter wire which would normally be clamped in the clamping area 9 and 10. In that instance, by continuing to force the wire into the clamping areas 11 or 12, the edges 14 will reliably separate the insulation.

In the construction illustrated, maintenance of the clamping area width is determined by projecting abutment portions 15 and 16 of the posts 5 and 6 which abut side walls of the center posts 4.

It will therefore be appreciated from the above that this invention provides a novel wire clamping electrically conductive element which is formed from sheet material. The sheet material is punched to form a free ended center post and two side post areas. Thereafter the material is folded back upon itself such that the side posts are of double thickness. One of the thicknesses of the side posts is formed with inside edge contours which cooperate with edge contours of the center post to define wire gripping slots. After folding, the center post can be bent back into side edge opposition with the contours of the one fold of the side posts. The slots, in the preferred embodiment have open ends at the folded over end of the side posts adjacent the free end of the center post. The slots sequentially decrease in size from an insertion area dimensioned to grip a wire by its insulation through a first slot width reduction area defined by cutting edges to a first wire clamping area having a dimension to conductively engage the conductive core of a wire thence through a second slot width reduction defined by a second set of cutting edges to a second clamping area having a dimension to engage the conductive core of a wire of diameter smaller than that engaged in the first clamping area.

Although the teachings of our invention have herein been discussed with reference to specific theories and embodiments, it is to be understood that these are by way of illustration only and that others may wish to utilize our invention in different designs or applications.

We claim as our invention:

1. A clamping element for electrically conductively clamping an insulated conductor without stripping the insulation comprising: a clamping member formed of punched sheet conductive material folded back upon itself defining spaced apart double thickness side post members and a single thickness center post member intermediate the side post members, inside edges of at least one of the thicknesses of each of the side post members positioned in opposition to side edges of the center post and defining therebetween conductor receiving slots, each slot being subdivided from an entrance opening into at least two clamping areas of progressively smaller width between the center post edge and the opposed side post edge, each clamping area having an opening thereto defined by insulating piercing contours of the post edges, each slot extending from an open end defined between the center post and a fold bend area of the side posts, the open end open to an insertion insulation opening having a width dimension between the center post and a fold bend area of the side posts, the open end open to an insertion insulation opening having a width dimension between side posts and center post edge walls to receive an insertion carrying conduit and to retain the same therein by engagement with the insulation, the insertion opening having a bottom defined by a first set of insulation cutting edges forming an opening to a first clamping area having a width dimension less than the insertion width dimension and effective to clamp a conductor of a first core diameter in electrically conductive engagement with the conductor core, the first clamping area having a bottom defined by a second set of insulation cutting edges forming an opening to a second clamping area having a width dimension less than the width dimension of the first clamping area and effective to clamp an electrical conductor of a smaller core diameter than the first clamping area in elecrtrically conductive core contact.

2. The element of claim 1 wherein each slot extends from an open end defined between the center post and a fold bend area of the side posts, the open end open to an insertion insulation opening having a width dimension between side posts and center post edge walls to receive an insertion carrying conduit and to retain the same therein by engagement with the insulation, the insertion opening having a bottom defined by a first set of insulation cutting edges forming an opening to a first clamping area having a width dimension less than the insertion width dimension and effective to enclamp a conductor of a first core diameter in electrically conductive engagement with the conductor core, the first clamping area having a bottom defined by a second set of insulation cutting edges forming an opening to a second clamping area having a width dimension less than the width dimension of the first clamping area and effective to clamp an electrical conductor of a smaller core diameter than the first clamping area in electrically conductive core contact.

3. The element of claim 1 wherein the central post is of single thickness and has a free end at an opening to the slots, the central post being bent at a double angle to extend parallel between first layers of the side posts adjacent the free end while being connected to second layers of the side posts remote from its free end, the first layer of the side posts having contoured edges defining the slots in conjunction with contoured edges of the center post.

4. The element of claim 3 wherein projecting portions of the side post engage side edges of the center post to define the initial width dimensions of the slots.

* * * * *